US006598705B2

(12) United States Patent
Ito et al.

(10) Patent No.: US 6,598,705 B2
(45) Date of Patent: Jul. 29, 2003

(54) LUBRICATING SYSTEM FOR INTERNAL COMBUSTION ENGINE

(75) Inventors: Katsuhiko Ito, Saitama (JP); Yoshihiro Yoshida, Saitama (JP); Kazuhiro Yasuda, Saitama (JP); Hideyuki Tawara, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/851,085

(22) Filed: May 9, 2001

(65) Prior Publication Data

US 2002/0003063 A1 Jan. 10, 2002

(30) Foreign Application Priority Data

May 9, 2000 (JP) ..... 2000-135667

(51) Int. Cl.[7] ..... F01M 1/20

(52) U.S. Cl. ..... 184/6.5; 123/196.5; 137/115.13; 184/6.4

(58) Field of Search ..... 184/6.4–6.9; 123/196 S, 123/196 CP; 137/115.13, 115.26, 881

(56) References Cited

U.S. PATENT DOCUMENTS 5,517,959 A * 5/1996 Kato et al. ..... 123/196 AB

FOREIGN PATENT DOCUMENTS

JP 05026022 A * 2/1993 ..... F01M/1/16
JP 05026024 A * 2/1993 ..... F01M/1/16
JP 2688926 8/1997

* cited by examiner

*Primary Examiner*—Chong H. Kim
(74) *Attorney, Agent, or Firm*—Birch, Stewart, Kolasch & Birch, LLP.

(57) ABSTRACT

An oil passage extending from an oil pump to a discharge port in an internal combustion engine is, at its halfway point, branched into at least two oil passages, for example, a first oil passage and a second oil passage. One of the at least two branched oil passages, for example, the second oil passage is provided with a restricting portion configured as a first orifice for restricting a flow amount of oil by reducing a diameter of the first orifice. A bypass valve is provided which acts, when a hydraulic pressure in the second oil passage exceeds a specific value, to bypass the first orifice so as to increase the flow rate of oil. It is possible to increase the hydraulic pressure at the time of low speed rotation up to a necessary pressure only by providing the restricting portion, without enhancing the performance of the oil pump. Accordingly, it is possible to suppress the increase in weight and cost of the lubricating system as compared with the prior art lubricating system in which the performance of the oil pump is enhanced, and since it is not required to increase the rotational speed of the oil pump, it is possible to prevent the loss in output of the internal combustion engine due to the increased friction of the oil pump. Further, it is possible to prevent an excessive increase in pressure of the oil passage by the effect of the bypass valve.

14 Claims, 6 Drawing Sheets

LUBRICATING SYSTEM FOR INTERNAL COMBUSTION ENGINE

BACKGROUND OF THE INVENTION

1. Field of the Invention

The present invention relates to a lubricating system for an internal combustion engine suitable for increasing a hydraulic pressure at the time of low speed rotation up to a necessary pressure without enhancing the performance of an oil pump.

2. Description of Background Art

A lubricating system for an internal combustion engine has been known, for example, from Japanese Patent No. 2688926 entitled "Engine Lubricating System for Motorcycle."

FIG. 1 illustrates an engine lubricating system in which a feed pump 22 is connected to an oil tank 8 and portions 25, to be lubricated, of the engine are connected to a discharge side of the feed pump 22 via a discharge side pipe line 24. A relief valve 27 is mounted to a halfway point of the discharge side pipe line 24 wherein lubricating oil in the discharge pipe line 24 is relieved to the oil tank 8 side when the hydraulic pressure in the discharge side pipe line 24 becomes a specific value or more, to thereby prevent the hydraulic pressure in the discharge side pipe line 24 from becoming the specific value or more.

As is known, in a rotary pump, a discharge pressure is proportional to the third power of the rotational number and is proportional to the fifth power of the diameter of an impeller.

Accordingly, in the feed pump 22 rotated by power from the engine described in the above document, when the engine speed is low, the pressure of the lubricating oil discharged from the feed pump 22 becomes significantly small.

For example, to make the pressure of the lubricating oil fed to the portions 25, to be lubricated, of the engine large even at a low engine speed, it may be conceived to increase the diameter of the impeller of the feed pump 22 or increase the rotational speed of the feed pump 22.

If the size of the feed pump 22 is made large to increase the diameter of the impeller, the size and weight of the feed pump 22 become large, and further the production cost of the feed pump is raised.

If the rotational speed of the feed pump 22 is increased, the friction of each sliding portion in the feed pump 22 becomes large, thereby degrading the pumping efficiency of the feed pump 22.

SUMMARY AND OBJECTS OF THE INVENTION

Accordingly, an object of the present invention is to provide a lubricating system for an internal combustion engine, which is capable of increasing the hydraulic pressure at the time of low speed rotation up to a necessary pressure without enhancing the performance of an oil pump.

To achieve the above object, according to the present invention, there is provided a lubricating system for an internal combustion engine, characterized in that an oil passage extending from an oil pump to a discharge port in an internal combustion engine is, at its halfway point, branched into at least two oil passages; and one of the at least two branched oil passages is provided with a restricting portion for restricting a flow amount of oil by reducing a diameter of the restricting portion, and a bypass valve which acts, when the hydraulic pressure in the oil passage exceeds a specific value, to bypass the restricting portion so as to increase the flow rate of oil.

Since one of at least two branched oil passages is provided with the restricting portion for restricting a flow amount of oil, hydraulic pressures in the at least two branched oil passages can be increased to pressures that are necessary at a low speed rotation of the engine, and when the hydraulic pressure of the one, provided with the restricting passage, of the at least two branched oil passages, exceeds a specific value, the excess increase in pressure of the oil passage can be prevented by opening the bypass valve to increase the flow rate of oil in the oil passage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, an embodiment of the present invention will be described with reference to the accompanying drawings.

Figure 1:
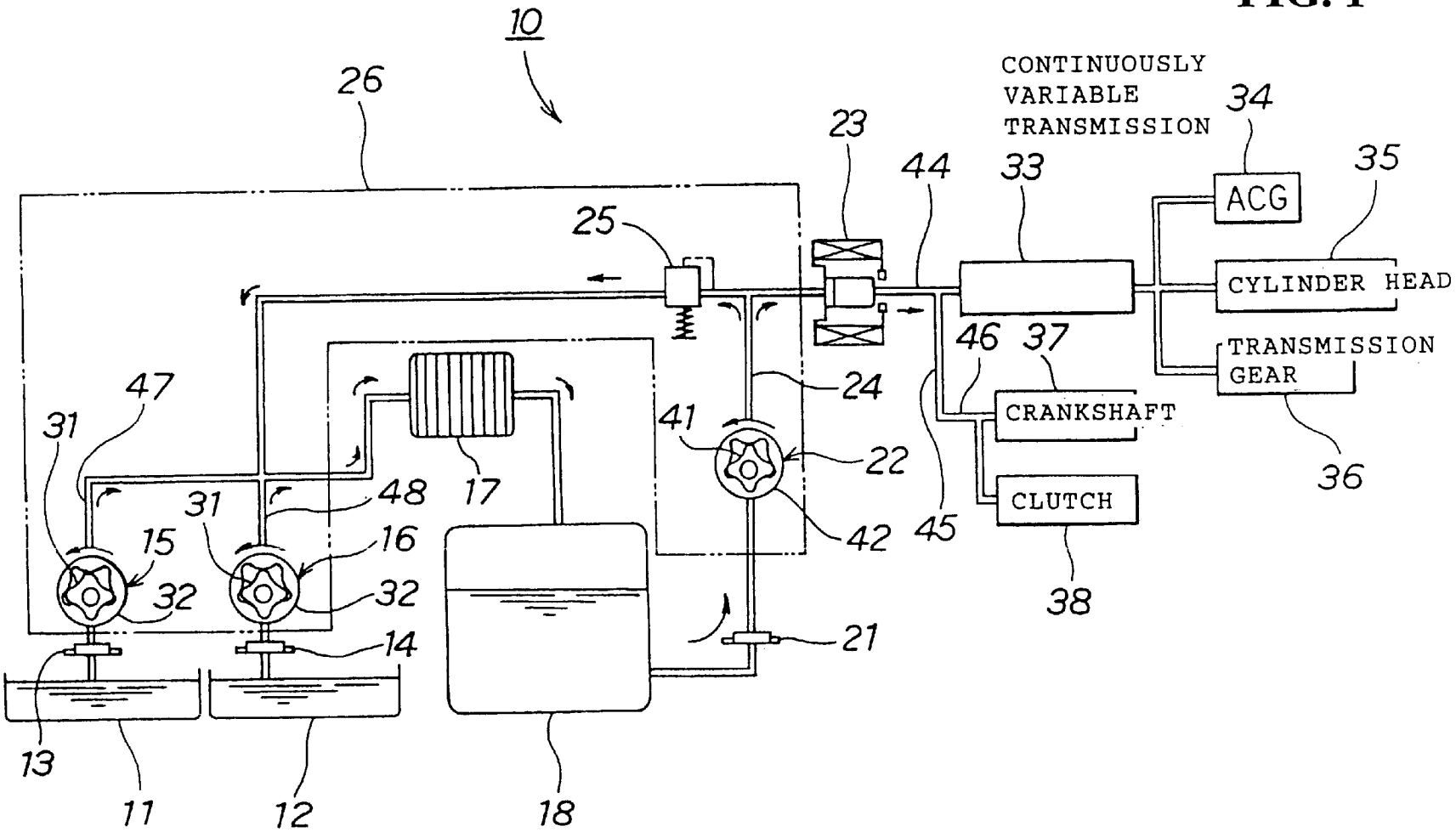
FIG. 1 is a distribution diagram of a lubricating system for an internal combustion engine according to the present invention.

FIG. 1 is a distribution diagram of a lubricating system for an internal combustion engine according to the present invention. A lubricating system 10, which is of a dry sump type, includes oil sumps 11 and 12 provided in a crankcase (not shown); scavenging pumps 15 and 16 connected to these oil sumps 11 and 12 via strainers 13 and 14; an oil cooler 17 connected to the discharge sides of these scavenging pumps 15 and 16; an oil tank 18 connected to the oil cooler 17; a feed pump 22 connected to the oil tank 18 via a strainer 21; an oil filter 23 connected to the discharge side of the feed pump 22; and a relief valve 25 connected to a feed pump discharge side oil passage 24 provided between the feed pump 22 and the oil filter 23.

The scavenging pumps 15 and 16, feed pump 22, and relief valve 25 constitute an oil pump 26.

The scavenging pumps 15 and 16 suck oil from the oil sumps 11 and 12 respectively, and supplies the oil to the oil tank 18. Each of the scavenging pumps 15 and 16 is of a trochoid type including an inner rotor 31 and an outer rotor 32 as shown in the figure.

The feed pump 22 supplies oil in the oil tank 18 to respective portions of the engine, for example, a continuously variable transmission 33 shown in FIG. 1, and also supplies the oil, via the continuously variable transmission 33, to respective sliding portions such as an ACG (AC generator) 34, a cylinder head 35, and a transmission gear 36. The feed pump 22 further supplies oil in the oil tank 18, via an oil passage different from the oil passage on the continuously variable transmission 33 side, to respective sliding portions such as a crankshaft 37 and a clutch 38. As shown in FIG. 1, the feed pump 22 is of a trochoid type including an inner rotor 41 and an outer rotor 42.

The oil passage extending from the oil filter 23 to the continuously variable transmission 33 is taken as a first oil passage 44; the oil passage branched from the first oil passage 44 and extending to the crankshaft 37 side and the clutch 38 side, which is equivalent to one of at least two branched oil passages is taken as a second oil passage 45; and an oil passage continuous to the second oil passage 45 is taken as a terminal oil passage 46.

The relief valve 25 is provided between the feed pump discharge side oil passage 24 and discharge side oil passages 47 and 48 of the scavenging pumps 15 and 16. The relief valve 25 acts to relieve, when the hydraulic pressure in the feed pump discharge side oil passage 24 exceeds a specific value, the oil in the feed pump discharge side oil passage 24 to the oil tank 18 connected to the discharge side oil passages 47 and 48 of the scavenging pumps 15 and 16.

The relief valve 25 prevents an excess hydraulic pressure from being applied to respective portions of the engine.

Figure 2:
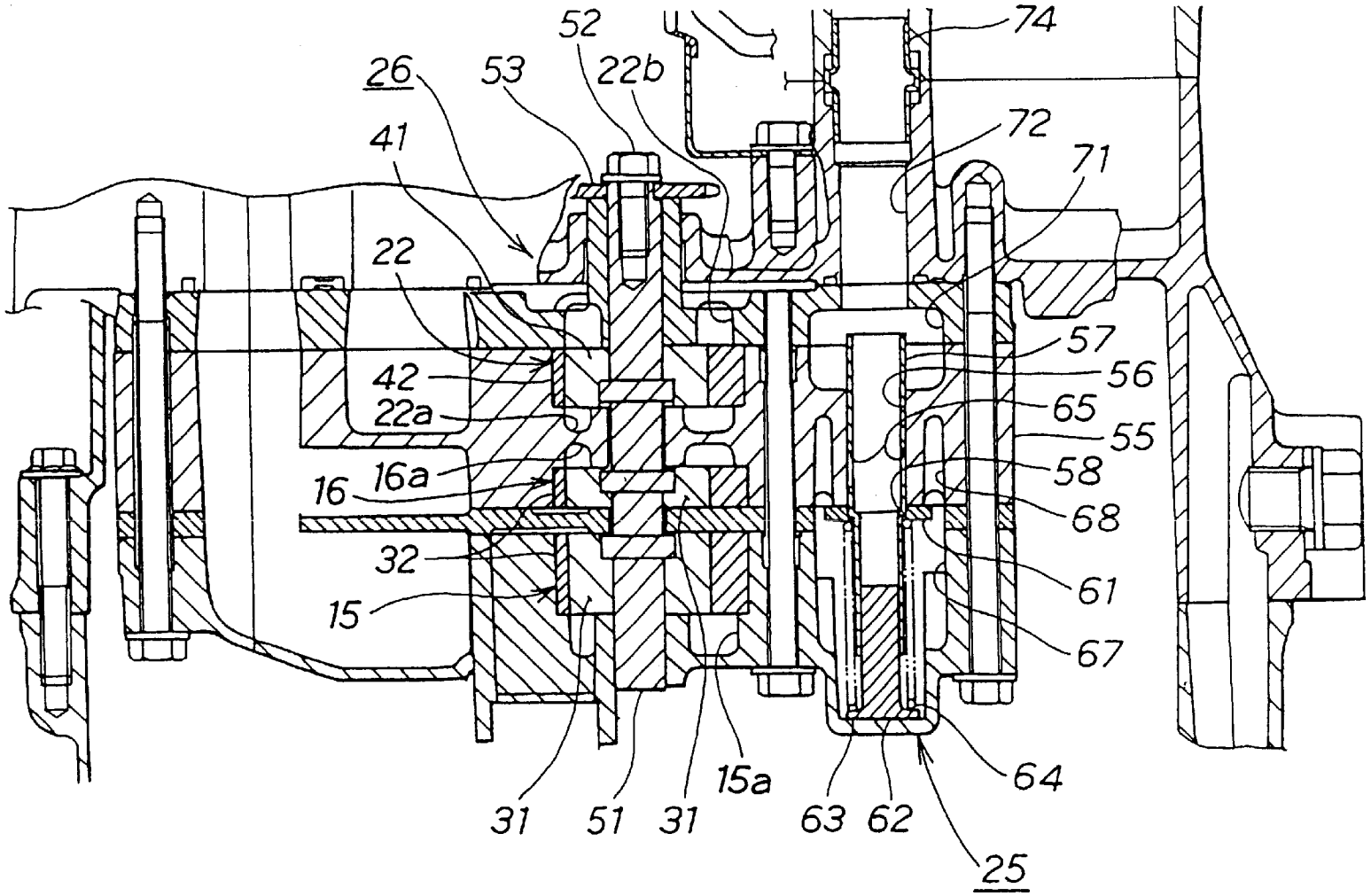
FIG. 2 is a first sectional view of an internal combustion engine including the lubricating system of the present invention.

FIG. 2 is a first sectional view of an internal combustion engine including the lubricating system of the present invention.

The oil pump 26 includes a pump shaft 51 common to the scavenging pumps 15 and 16 and the feed pump 22. The rotation of the pump shaft 51 drives the inner rotor 31 and the outer rotor 32 of each of the scavenging pumps 15 and 16 and also drives the inner rotor 41 and the outer rotor 42 of the feed pump 22. In FIG. 2, a discharge side chamber 15*a* of the scavenging pump 15; a discharge side chamber 16*a* of the scavenging pump 16; a discharge side chamber 22*a* of the feed pump 22; and a suction side chamber 22*b* of the feed pump 22 are provided.

A sprocket 53 is mounted to an end portion of the pump shaft 51 with a bolt 52. A chain is wound around the sprocket 53 and a sprocket (not shown) mounted on a crankshaft 37 (not shown in FIG. 2), whereby the pump shaft 51 is rotated together with the crankshaft 37.

The relief valve 25 includes a cylindrical valve body 57 removably inserted in a valve insertion hole 56 formed in a case 55. A spring receiving portion 61 is mounted on a stepped portion 58 of the valve body 57. A guide member 62 is removably inserted in a hollow portion at an end portion of the valve body 57. A spring 64 is interposed between a flange portion 63 of the guide member 62 and the spring receiving portion 61. The spring 64 is biased to push up the valve body 57 and the spring receiving portion 61.

The valve body 57 has two oil communication holes 65 which extend from an outer peripheral surface to an inner peripheral surface of the cylindrical valve body In FIG. 2, a first oil chamber 67 communicates with the discharge side chamber 15*a* of the scavenging pump 15; a second oil 68 communicates with the discharge side chamber 16*a* of the scavenging pump 16; a third oil chamber 71 communicates with the discharge side chamber 22*a* of the feed pump 22; and a third oil passage 72 is provided.

Figure 3:
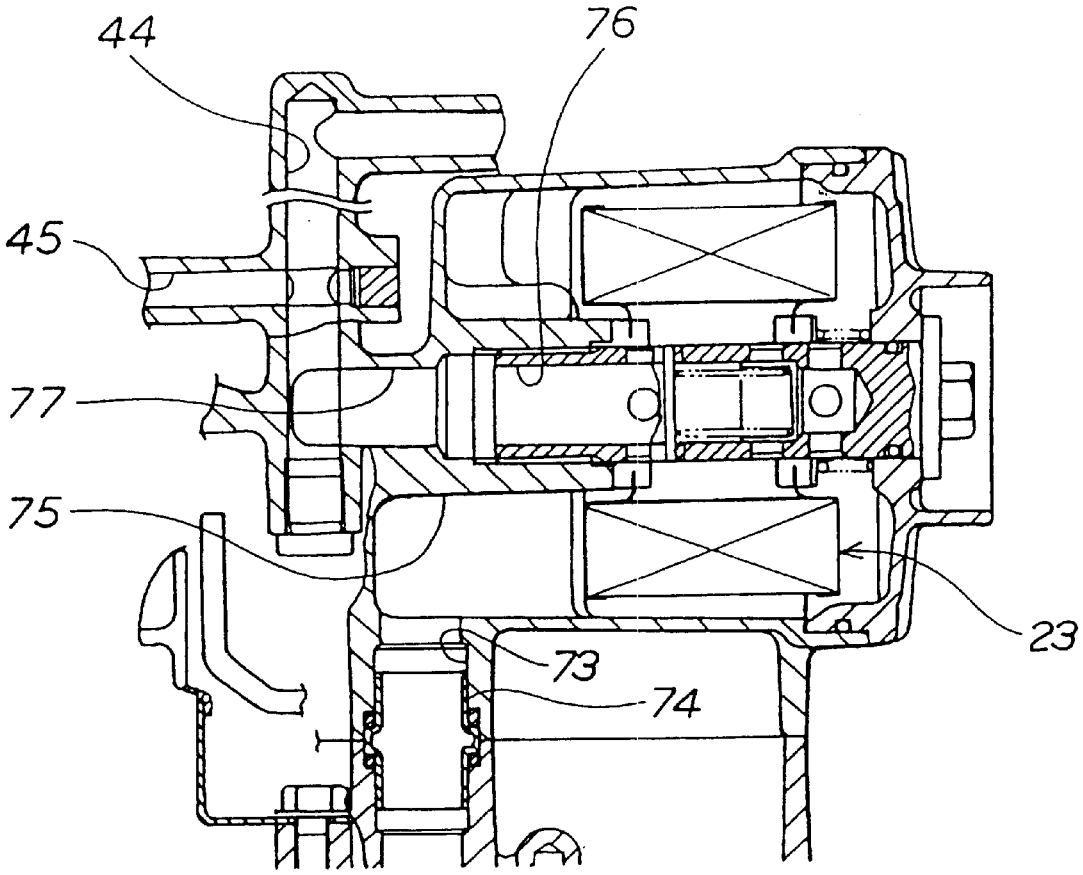
FIG. 3 is a second sectional view of an internal combustion engine including the lubricating system of the present invention.

FIG. 3 is a second sectional view of the internal combustion chamber including the lubricating system of the present invention, showing a structure of the oil filter and adjacent elements.

In FIG. 3, a fourth oil passage 73 is continuous to the third oil passage 72 (see FIG. 2); a pipe 74 connects with the third oil passage 72 to the fourth oil passage 73; an oil filter chamber 75 is provided for containing the oil filter 23; an oil passage 76 is provided in the oil filter 23; and a fifth oil passage 77 communicates with the oil passage 76 in the oil filter 23 to the first oil passage 44.

The flow of oil supplied by the oil pump 26 described above will be described with reference to FIGS. 2 and 3.

As shown in FIG. 2, oil is supplied from the discharge side chamber 22*a* to the third oil chamber 71 through the feed pump discharge side oil passage 24 (see FIG. 1) by the feed pump 22. The oil passes through the third oil chamber 71 and the third oil passage 72, and as shown in FIG. 3, further passes through the connecting pipe 74, fourth oil passage 73, oil filter chamber 75, oil filter 23, oil passage 76 in the oil filter 23, and fifth oil passage 77, and reaches respective portions of the engine through the first oil passage 44 and the second oil passage 45.

Referring to FIG. 2, when the hydraulic pressure in the third oil chamber 71 on the discharge side of the feed pump 22 is increased up to more than a specific value, the valve body 57 of the relief valve 25 is moved downwardly against an elastic force of the spring 64, so that the oil communication holes 65 of the valve body 57 are moved downwardly to positions lower than the case 55 to face to the inside of the first oil chamber 67. As a result, oil in the third oil chamber 71 passes through the oil communication holes 65 of the valve body 57 and flows in the first oil chamber 67 and the second oil chamber 68. The oil, which has passed through the first oil chamber 67 and the second oil chamber 68, reaches the discharge side oil passages 47 and 48 (see FIG. 1) of the scavenging pumps 15 and 16, and flows in the oil tank 18 (see FIG. 1). Accordingly, it is possible to prevent an excess increase in hydraulic pressure in the third oil chamber 71.

Figure 4:
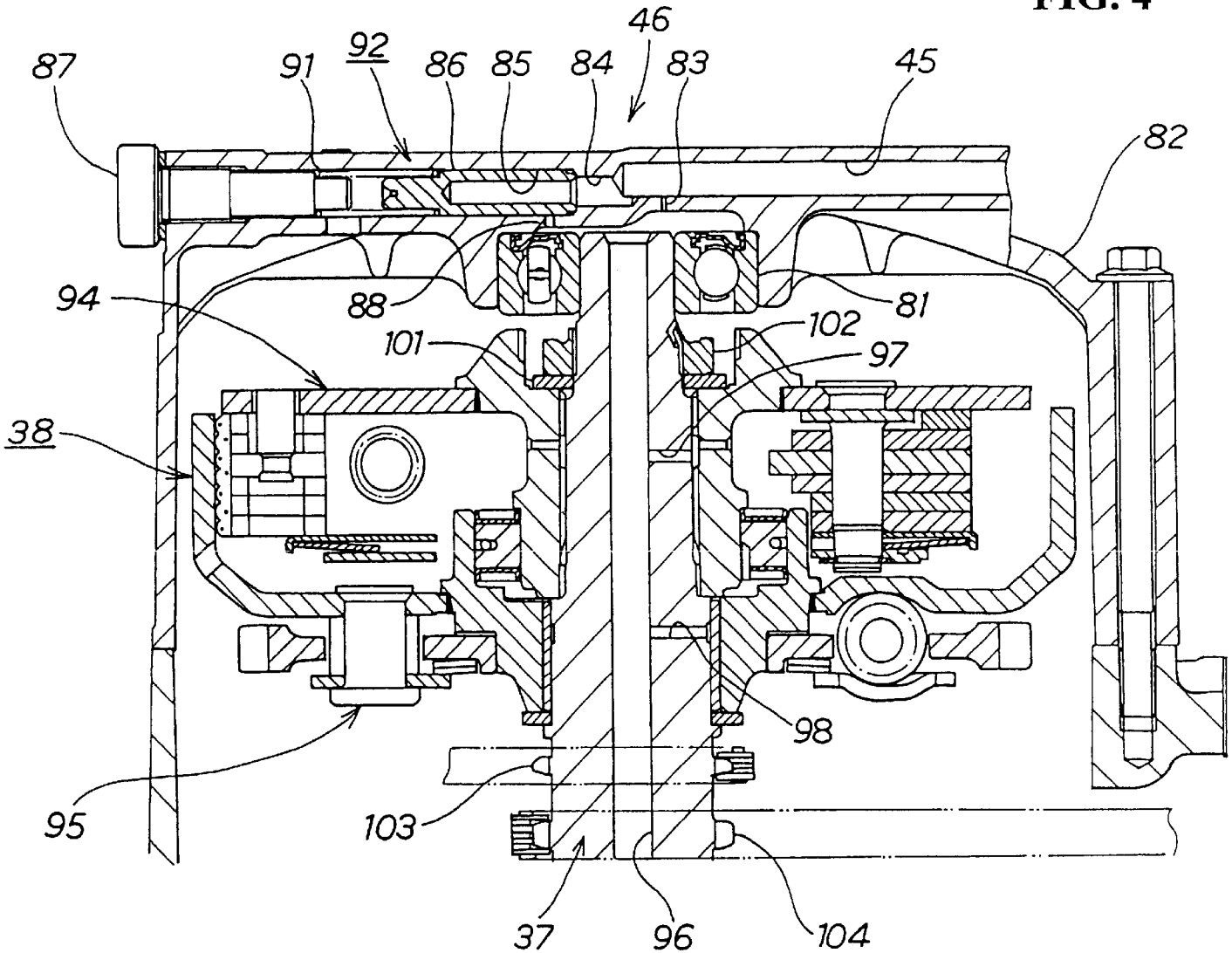
FIG. 4 is a sectional view of an essential portion of the lubricating system of the present invention.

FIG. 4 is a sectional view of an essential portion of the lubricating system of the present invention. One end portion of the crankshaft 37 is supported by a case cover 82 via a bearing 81. The second oil passage 45 is branched from the first oil passage 44 (see FIG. 3), communicates to the continuously variable transmission 33 (see FIG. 1) and is formed in the case cover 82. A first orifice hole 83, acting as the restricting portion for communicating the second oil passage 45 to the inside of the case cover 82, is formed in the case cover 82. A valve insertion hole 85 is communicated to an end portion of the second oil passage 45 via a connecting oil passage 84, and a valve body 86 is movably inserted in the valve insertion hole 85. An end portion of the valve insertion hole 85 is blocked with a plug 87. A second orifice 88 for communicating the valve insertion hole 85 to the inside of the case cover 82 is formed in the case cover 82. The valve body 86 is biased in the direction in which the valve body 86 blocks the second orifice 88 by a spring 91.

The first orifice 83, connecting oil passage 84, valve insertion hole 85, and second orifice 88 constitute the terminal oil passage 46 described with reference to FIG. 1.

The valve insertion hole 85, valve body 86, second orifice 88, and spring 91 constitute a bypass valve 92 as a valve body.

Further, as shown in FIG. 4, an input side member 94 constituting part of the clutch 38 is spline-connected to the crankshaft 37 and an output side member 95 constituting part of the clutch 38 is rotatably mounted to the crankshaft 37.

In FIG. 4, an oil passage 96 passes through the center of the crankshaft 37; small oil passages 97 and 98 extend from the oil passage 96 in the crankshaft 37 to the input side member 94 side and the output side member 95 side, respectively; a washer 101 and a nut 102 member are provided for preventing slip-off of the clutch 38 from the crankshaft 37, respectively; and sprockets 103 and 104 are integrally formed on the crankshaft 37.

The functions of the above-described first orifice 83, second orifice 88, and bypass valve 92 will be described below.

Figure 5A:
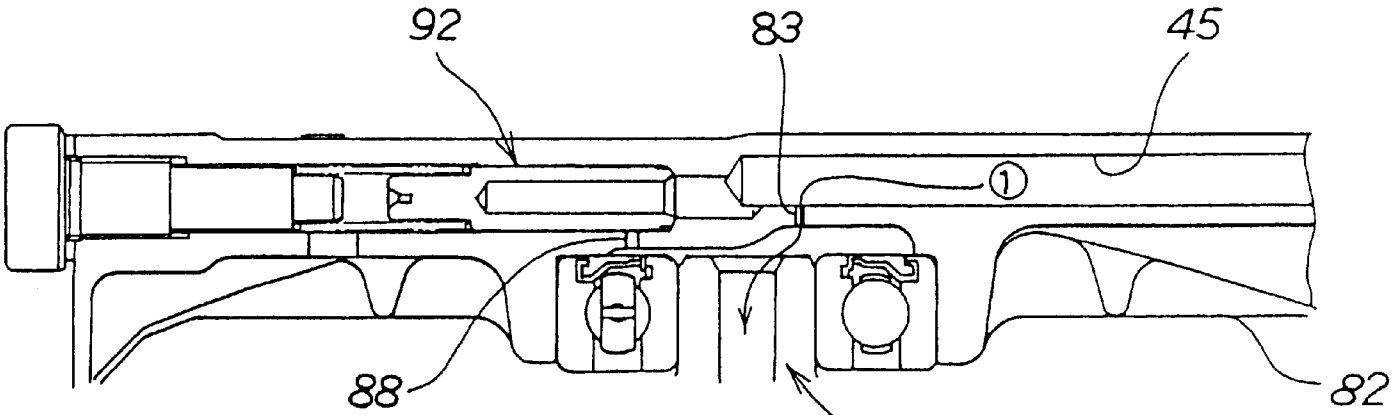
FIGS. 5(*a*) and 5(*b*) are views illustrating the function of the lubricating system of the present invention.
Figure 5B:
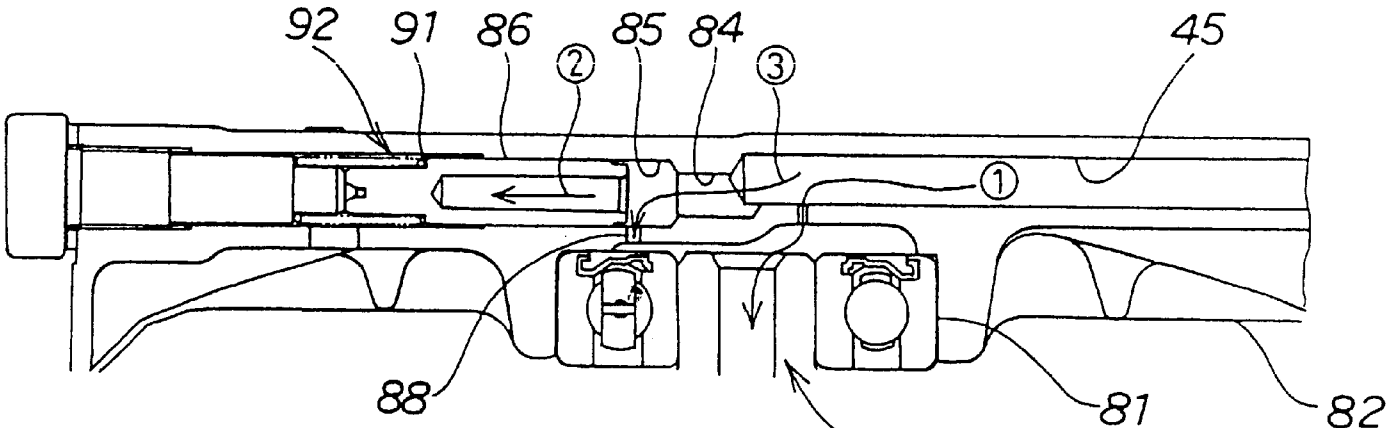

FIGS. 5(*a*) and 5(*b*) are views illustrating the function of the lubricating system of the present invention.

Referring to FIG. 5(*a*), at the time of low speed rotation of the engine, the rotational speed of the pump shaft of the oil pump is low and the amount of oil supplied from the feed pump to the second oil passage 45 is small. However, the flow of the oil toward the crankshaft 37 side and the clutch side in the case cover 82 as shown by an arrow (1) is restricted by the first orifice 83, with a result that the hydraulic pressure in the second oil passage 45 becomes high.

Along with the increased hydraulic pressure in the second oil passage 45, the hydraulic pressure in the first oil passage 44 (see FIG. 3) communicates to the second oil passage 45 also becomes high, so that it is possible to ensure a high hydraulic pressure necessary for operating the continuously variable transmission 33 (see FIG. 1) connected to the first oil passage 44.

Referring to FIG. 5(*b*), when the discharge pressure of the feed pump is further increased with the increased engine speed and thereby the hydraulic pressure in the second oil passage 45 exceeds a specific value, the valve body 86 in the bypass valve 92 is moved leftwardly against the elastic force of the spring 91 as shown by an arrow (2), with a result that the oil in the second oil passage 45 flows, in addition to the flow shown by the arrow (1) described with reference to FIG. 5(*a*), into the case cover 82 through the connecting oil passage 84, valve insertion hole 85, and second orifice 88 as shown by an arrow (3), to lubricate the bearing 81, crankshaft 37, clutch 38, and the like.

Figure 6:
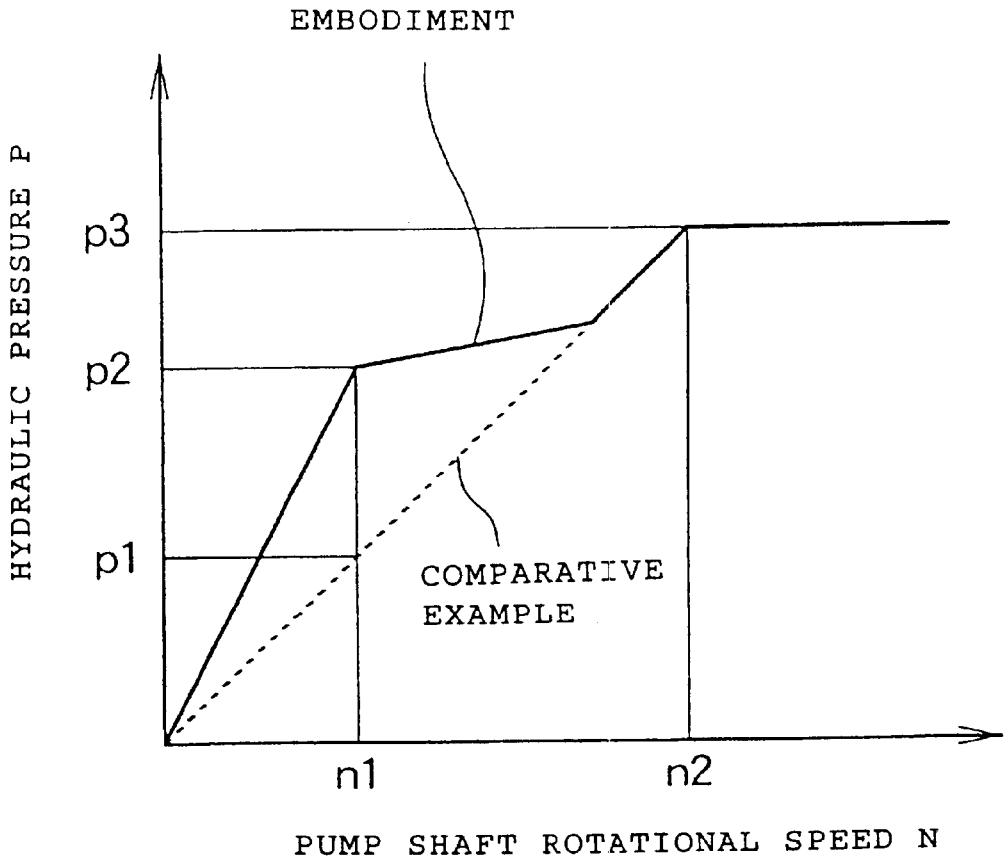
FIG. 6 is a graph illustrating the function of the lubricating system of the present invention.

FIG. 6 is a graph illustrating the function of the lubricating system of the present invention, which shows a relationship between a hydraulic pressure in the oil passages on the discharge side of the feed pump 22, that is, the first oil passage 44 and the second passage 45 and a rotational speed of the pump shaft 51 (see FIGS. 2 to 4) of the oil pump 26.

In the graph, the ordinate designates a hydraulic pressure P in the first oil passage 44 and the second oil passage 45, and the abscissa designates a pump shaft rotational speed N of the pump shaft 51.

In a comparative example (equivalent to the above-described prior art lubricating system), which is not provided with the first orifice 83 according to this embodiment and is configured such that when the discharge pressure of the oil pump exceeds a specific value, oil is simply relieved by means of a relief valve, the hydraulic pressure P is gradually increased with an increase in pump shaft rotational speed N as shown by a broken line, and when the pump shaft rotational speed N becomes a value n2, the hydraulic pressure P reaches a specific pressure P3.

On the contrary, in the lubricating system of this embodiment, since the first orifice 83 is provided, the hydraulic pressure P of the first oil passage 44 and the second oil passage 45 is increased with a gradient larger than that in the comparative example along with an increase in pump shaft rotational speed N as shown by a solid line; the bypass valve 92 starts to be opened when the hydraulic pressure P becomes a value p2 at the pump shaft rotational speed N=n1; the hydraulic pressure P is gradually increased until the pump shaft rotational speed N becomes a value n2; and the hydraulic pressure P reaches the specific pressure p3 when the pump shaft rotational speed N becomes the value n2.

That is to say, at the same pump shaft rotational speed N=n1, the hydraulic pressure P=p2 in this embodiment is larger than the hydraulic pressure P=p1 in the comparative example. In this way, according to the lubricating system of this embodiment, it is possible to obtain a hydraulic pressure larger than that in the comparative example at the same pump shaft rotational speed.

As described with reference to FIGS. 2 to 4, the present invention is characterized in that an oil passage extending from an oil pump 26 to a discharge port in an internal combustion engine is, at its halfway point, branched into at least two oil passages, for example, a first oil passage 44 and a second oil passage 45; and one of the at least two branched oil passages, for example, the second oil passage 45 is provided with a restricting portion configured as a first orifice 83 for restricting a flow amount of oil by reducing a diameter of the first orifice 83, and a bypass valve 92 which acts, when a hydraulic pressure in the second oil passage 45 exceeds a specific value, to bypass the first orifice 83 so as to increase the flow rate of oil.

With this configuration, the hydraulic pressure at the time of low speed rotation can be increased up to a necessary pressure only by providing the first orifice 83, without enhancing the performance, for example, without increasing the diameter of the impeller of the oil pump 26 and increasing the rotational speed of the oil pump 26.

Accordingly, it is possible to suppress the increase in weight and cost of the lubricating system as compared with the prior art lubricating system in which the performance of the oil pump 26 is enhanced, and since it is not required to increase the rotational speed of the oil pump 26, it is possible to present the loss in output of the internal combustion engine due to the increased friction of the oil pump 26.

Further, it is possible to prevent an excessive increase in pressure of the first oil passage 44 and the second oil passage 45 by the effect of the bypass valve 92.

The present invention configured as described above exhibits the following effects:

The lubricating system for an internal combustion engine includes an oil passage extending from an oil pump to a discharge port in an internal combustion engine that, at its halfway point, is branched into at least two oil passages. One of the at least two branched oil passages is provided with a restricting portion for restricting a flow amount of oil by reducing a diameter of the restricting portion, and a bypass valve which acts, when hydraulic pressure in the oil passage exceeds a specific value, to bypass the restricting portion so as to increase the flow rate of oil. Accordingly, it is possible to increase the hydraulic pressure at the time of low speed rotation up to a necessary pressure only by providing the restricting portion, without enhancing the performance of the oil pump.

Accordingly, it is possible to suppress the increase in weight and cost of the lubricating system as compared with the prior art lubricating system in which the performance of the oil pump is enhanced, and since it is not required to increase the rotational speed of the oil pump, it is possible to prevent the loss in output of the internal combustion engine due to the increased friction of the oil pump.

Further, it is possible to prevent an excessive increase in pressure of the oil passage by the effect of the bypass valve.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating system for an internal combustion engine, comprising:

an oil passage extending from an oil pump to a discharge port in an internal combustion engine is branching into at least two branched oil passages; and one of said at least two branched oil passages is provided with a first restricting portion having a diameter smaller than a diameter of said one of said at least two branched oil passages, said first restricting portion for restricting a flow amount of oil, and a bypass valve which acts, when a hydraulic pressure in said oil passage exceeds a specific value, to divert a portion of the oil to a second restricting portion so as to increase the flow of oil, wherein a continuously variable transmission is driven by hydraulic pressure of the oil from another of said at least two branched oil passages.

2. The lubricating system for an internal combustion engine according to claim 1, wherein said one of said at least two branched oil passages includes a first section and a second section, said second section including said bypass valve being movably mounted therein for selectively permitting oil to flow into said second section when the hydraulic pressure in the oil passage exceeds a specified value.

3. The lubricating system for an internal combustion engine according to claim 2, wherein said first section includes said first restricting portion for enabling a predetermined quantity of oil to flow from said one of said at least two branched oil passages prior to actuation of said bypass valve.

4. The lubricating system for an internal combustion engine according to claim 3, wherein said first restricting portion is an orifice of a predetermined size for restricting the flow of oil from said one of said at least two branched oil passages prior to actuation of said bypass valve.

5. The lubricating system for an internal combustion engine according to claim 1, wherein said bypass valve is normally biased to a first position for preventing the flow of oil to a second section and is moved to permit a flow of oil to said second section when the hydraulic pressure in the oil passage exceeds the specific value.

6. The lubricating system for an internal combustion engine according to claim 5, wherein the second section includes said second restricting portion for providing a flow of oil for lubricating a portion of said internal combustion engine.

7. A lubricating system for an internal combustion engine, comprising:

an oil passage extending from an oil pump to a discharge port in an internal combustion engine, said oil passage provided with a first restricting portion having a diameter smaller than a diameter of said oil passage, said first restricting portion for restricting a flow of oil; and a bypass valve actuated to open when a hydraulic pressure in said oil passage exceeds a specific value, to divert a portion of the oil to a second restricting portion so as to increase the flow of oil, wherein a continuously variable transmission is driven by hydraulic pressure of the oil from another oil passage branching from said oil passage.

8. The lubricating system for an internal combustion engine according to claim 7, wherein said oil passage includes a first section and a second section, said second section including said bypass valve being movably mounted therein for selectively permitting oil to flow into said second section when the hydraulic pressure in the oil passage exceeds a specified value.

9. The lubricating system for an internal combustion engine according to claim 8, wherein said first section includes said first restricting portion for enabling a predetermined quantity of oil to flow from said oil passage prior to actuation of said bypass valve.

10. The lubricating system for an internal combustion engine according to claim 9, wherein said first restricting portion is an orifice of a predetermined size for restricting the flow of oil from said oil passage prior to actuation of said bypass valve.

11. The lubricating system for an internal combustion engine according to claim 7, wherein said bypass valve is normally biased to a first position for preventing the flow of oil to a second section and is moved to permit a flow of oil to said second section when the hydraulic pressure in the oil passage exceeds the specific value.

12. The lubricating system for an internal combustion engine according to claim 11, wherein the second section includes a second restricting portion for providing a flow of oil for lubricating a portion of said internal combustion engine.

13. The lubricating system for an internal combustion engine according to claim 1, said bypass valve further comprising a valve insertion hole, said valve insertion hole being blocked by a plug extending externally to the valve insertion hole.

14. The lubricating system for an internal combustion engine according to claim 7, said bypass valve further comprising a valve insertion hole, said valve insertion hole being blocked by a plug extending externally to the valve insertion hole.

* * * * *